US006170109B1

(12) United States Patent
Jesadanont et al.

(10) Patent No.: US 6,170,109 B1
(45) Date of Patent: Jan. 9, 2001

(54) AUTOMATIC MACHINES FOR CLEANING OUTER WALL OF A HIGH-RISE BUILDING

(76) Inventors: Mongkol Jesadanont; Apijade Jesadanont; Sukanya N. Jesadanont, all of 386/2 Ratchadaphisek 44, Ratchadaphisek Rd., Chatuchak, Bangkok 10900 (TH)

( * ) Notice: Under 35 U.S.C. 154(b), the term of this patent shall be extended for 0 days.

(21) Appl. No.: 09/311,377

(22) Filed: May 13, 1999

(51) Int. Cl.[7] ..... A47L 1/02

(52) U.S. Cl. ..... 15/50.3; 15/52.1; 15/302; 15/103

(58) Field of Search ..... 15/50.1, 50.3, 15/52.1, 302, 320, 103

(56) References Cited

U.S. PATENT DOCUMENTS

| | | | | |
|---|---|---|---|---|
| 3,497,902 | | 3/1970 | Hartigan | 15/302 |
| 3,604,049 | * | 9/1971 | Hetman | 15/302 |
| 3,641,607 | | 2/1972 | Lemelson | 15/4 |
| 4,025,984 | * | 5/1977 | Hoener, Jr. | 15/302 |
| 4,112,535 | * | 9/1978 | Wild et al. | 15/302 X |
| 4,136,419 | * | 1/1979 | Hetman et al. | 15/302 |
| 4,198,724 | * | 4/1980 | Fisher et al. | 15/302 |
| 4,257,138 | | 3/1981 | Clements et al. | 15/4 |
| 4,797,969 | * | 1/1989 | Caduff | 15/302 |
| 4,800,607 | * | 1/1989 | Fukutomi | 15/103 |
| 5,465,446 | | 11/1995 | Chang | 15/50.3 |
| 5,655,247 | * | 8/1997 | Allen et al. | 15/103 |
| 5,715,557 | | 2/1998 | Hsu | 15/50.3 |
| 5,890,250 | * | 4/1999 | Lange et al. | 15/50.3 |

FOREIGN PATENT DOCUMENTS

| | | | | |
|---|---|---|---|---|
| 53-139359 | * | 12/1978 | (JP) | 15/320 |
| 1-163517 | * | 6/1989 | (JP) | 15/52.1 |
| 5-49554 | * | 3/1993 | (JP) | 15/302 |
| 6-90885 | * | 4/1994 | (JP) | 15/302 |

* cited by examiner

*Primary Examiner*—Mark Spisich

(57) ABSTRACT

A machine for cleaning the outer wall of a high-rise building using a pneumatic system or a vacuum system consists of a case divided into three chambers vertically arranged having an opened-anterior side where edges of all chambers having rubber plates or brushes mounted all along their rims. In each upper and lower chamber there is mounted a roller having its surface aligned with an edge of the rubber plates or brushes. The machine is pressed against a wall to be cleaned be either a pneumatic or vacuum mechanism. The machine moves along a wall which cleaning by shifting a cable tied at the top of a case. In a middle chamber, there is a drum-brush whose hair sticks out over the level of the edge of the rubber plate or brushes. There is also tubing to eject water and/or detergent solution to the drum-brush, and where the drum-brush is motor-driven in cleaning the wall.

1 Claim, 7 Drawing Sheets

AUTOMATIC MACHINES FOR CLEANING OUTER WALL OF A HIGH-RISE BUILDING

BACKGROUND OF THE INVENTION

1. Technical Field of the Invention

The present invention relates to an automatic cleaning machine for outer wall of high-rise buildings which can vertically move during cleaning action and easy to operate.

2. Description of the Prior Art

At present, cleaning high-rise surfaces such as glass windows, outer wall of high-rise buildings and advertising boards are unavoidable. Yet, there is not any efficient machine for such purpose. Manual cleaning using personnels to be carried with the platform is generally used which is laborious, dangerous, time-consuming and very costly, yet the outcome is not satisfactory since there are many blind spots on the large area which limit the range of manual cleaning. Hazard can also happen by abnormal air turbulance between high-rise buildings. Besides, sun-burning or wind-chilling atmosphere makes it even more difficult to find labors for such work with the very high risk.

There have been prior inventions; U.S. Pat. No. 5,465,446 of Chang KK and U.S. Pat. No. 5,715,557, which can work automatically. However, their machines can do the cleaning action only when the machines are held in fixed position on the wall by mean of vacuum suction cups which require very smooth surface to do so. On a normal slightly rough surface like the outer surface of a concrete wall, it is thus impossible to use their machines since there will always be small empty spaces for air to continuously flow through and therefore vacuum can not be achieved.

The present invention, however, can clean both thoroughly smooth surfaces like glass windows and slightly rough surfaces like cement walls outside high-rise buildings with highest efficiency. This machine can move at the same time while it is cleaning the surfaces and thereby cleaning can be performed continuously and save lots of time and efforts.

SUMMARY OF THE INVENTION

A machine for cleaning outer wall of a high-rise building using a pneumatic system consists of a case divided into at least 3 chambers vertically arranged having an opened-anterior side where the edge of each of the three chambers having rubber plates or brushes mounted all along its rim.

In each upper and lower chamber there mounted a roller having its surface align with edge of said rubber plate. At the back of each of two chambers, there is a hollow tube mounted thereto with one end inside and the other end outside each chamber. Within each hollow tube at its external part outside the machine case, there is a right-angled tube installed with its one end inside the hollow tube pointed away from the case and its other end outside the hollow tube connected to an air pump in a manner that when the pump is turned on, there creates forces resulting in pressing the machine against a wall to be cleaned. Machine can move vertically by mean of pulling or releasing a cable tied at the top of the case.

In the middle chamber of the machine, there is a drum-brush whose hair sticking out over the level of said rubber plate edge, where at the back of middle chamber there is tubing(s) to eject water and/or detergent solution to the drum-brush, and where the drum-brush is motor-driven in cleaning the wall. This machine is pressed against a wall to be cleaned by using a pneumatic system or a vacuum system, and is able to move along the wall while cleaning.

DESCRIPTION OF THE PREFERRED EMBODIMENTS

Machines for cleaning outer wall of high-rise buildings are invented to clean outer surface which is slightly rough like those cement walls and those thoroughly smooth like those glass windows.

The principle in operating these machines and the great advantage over those prior arts is that simultaneous while the machine is cleaning, it can move along the surface to be cleaned.

Figure 1:
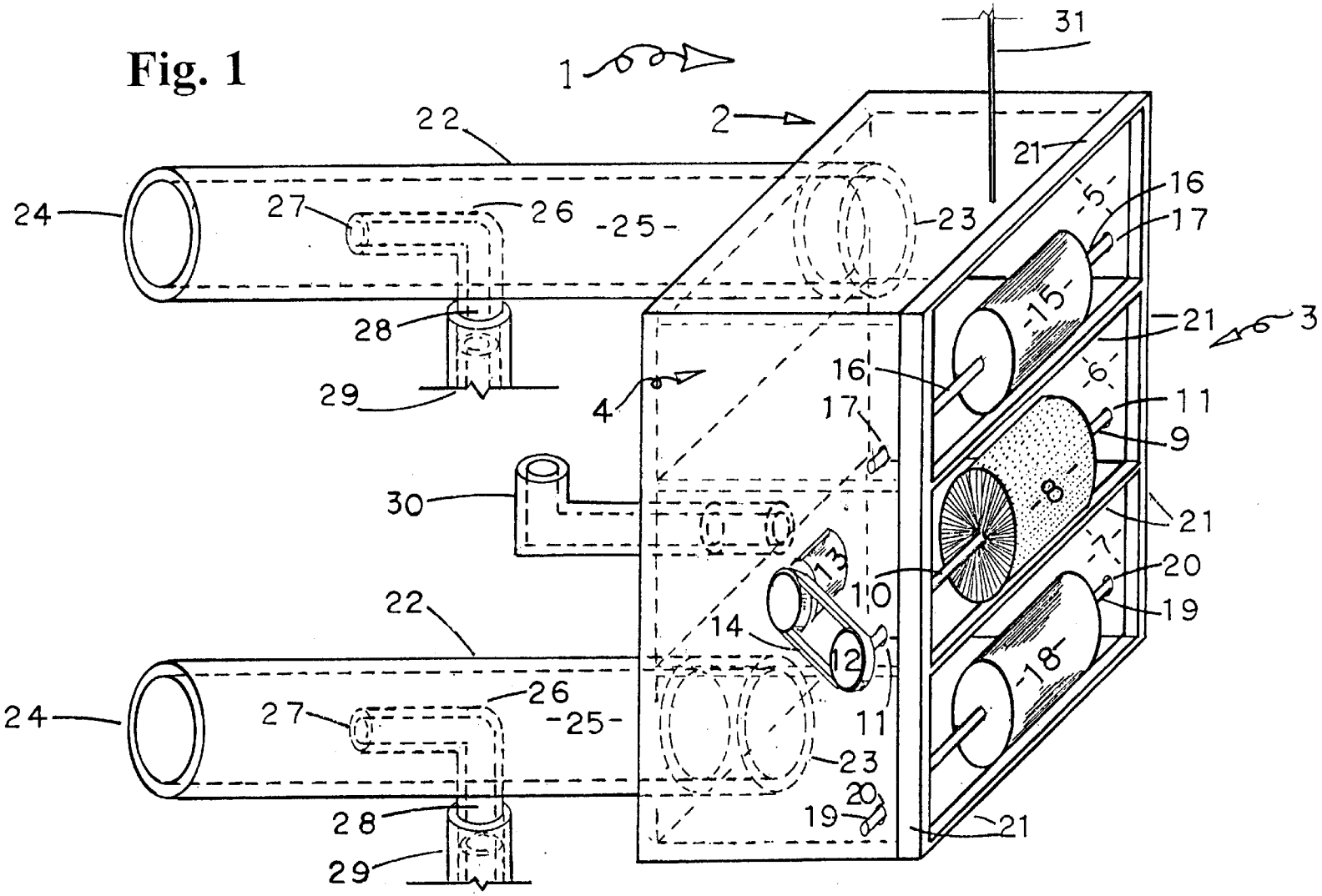
FIG. 1 shows the structure of the invention of pneumatic type in three dimensions.

There are two systems that can be used to press the machine against the wall while cleaning; i.e., 1. Pneumatic System:

As shown in FIG. 1, machine 1 is a machine for cleaning outer wall of a high-rise building consists of a case 2 (can be made of either plastic or stainless steel). Side 3 is an opened side of case 2 which is an anterior side while all the other sides are closed and side 4 is a posterior side of case 2.

Case 2 is divided into 3 chambers: chamber 5, chamber 6 and chamber 7.

In chamber 6, there is a drum-brush 8 installed thereto having two shafts 9 and 10 rotating within circular holes or ball bearing cartridges 11. Shaft 10 extends outside case 2 with its end having a pulley 12 mounted thereto. Drum-brush 8 rotates about its axis to do the cleaning action when a motor 13 installed outside case 2 is turned on to rotate shaft 10 through pulley 12 and conveyor belt 14.

In chamber 5, there is a roller 15 with its shafts 16 rotates about its axis within circular holes or ball bearing cartridges 17.

In chamber 7, there is a roller 18 with its shafts 19 rotates about its axis within circular holes or ball bearing cartridges 20.

Roller 15 is identical to roller 18 can be made of either plastic or rubber. The shafts are made of metal. The two rollers allows proper moving of machine 1 along the surface to be cleaned and prevent the machine not to be pressed to close to the wall but remains at a constant distance such that the hairs of drum-brush 8 can be pressed onto the wall with consistently uniform force all through the cleaning action.

At anterior side 3 of case 2, there mounted rubber plate or brush 21 all along the edges of chambers 5, 6 and 7.

Figure 2:
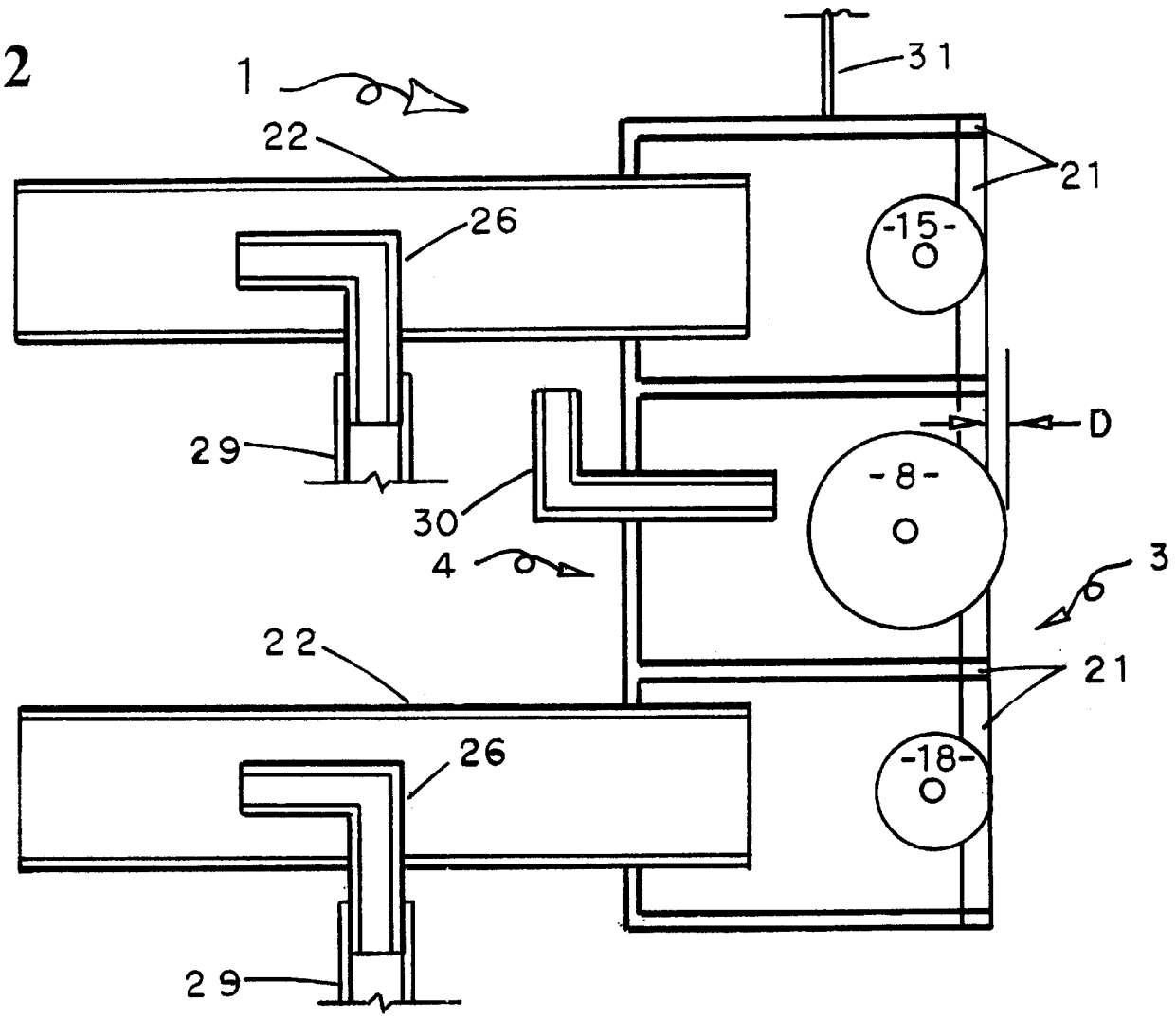
FIG. 2 is a sectional side view of the invention shows how all the components are arranged.

As shown in FIG. 2, surface of roller 15 and 18 are aligned at the same level as the rim of rubber plate 21, while the tip of the hairs of brush 8 stretch out to a distance D (which can be 1, 2 or 3 centimeters as designed). This distance D depends on the size of pressing force exerts by the brush hairs onto the wall.

At posterior side 4 of case 2, there are rigid hollow tubes 22 with empty spaces 25 installed at both chamber 5 and chamber 7. Ends 23 of tubes 22 are inside case 2 while their outer ends 24 are outside case 2.

At part of tubes 22 outside case 2, each there is a right-angled tubing 26 mounted to having its end 27 within space 25 of tube 22 and points towards end 24 of tube 22.

The other end 28 of right-angled tubing 26 sticking outside tube 22 is connected to pipe 29 which is a rubber or plastic pipe of an air pump. Air pump is an important component of pneumatic system of machine 1 and is conventional. Air pump can be installed either at the lowest floor or at the top floor of a high-rise building and must be able to pump the air at a high velocity and a high pressure (about 1500 psi) great enough to press machine 1 against the wall to be cleaned while machine 1 simultaneously moves downward. Machine 1 is hanging from the top floor of a high-rise building through a cable 31 which is tied to the top of case 2 to allow machine 1 to move vertically by pulling or releasing the cable.

At the back of chamber 6, there is a tube 30 mounted to for delivering water or cleaning solution to be ejected to brush 8 by a water pump installed at the top floor of the building.

Figure 3:
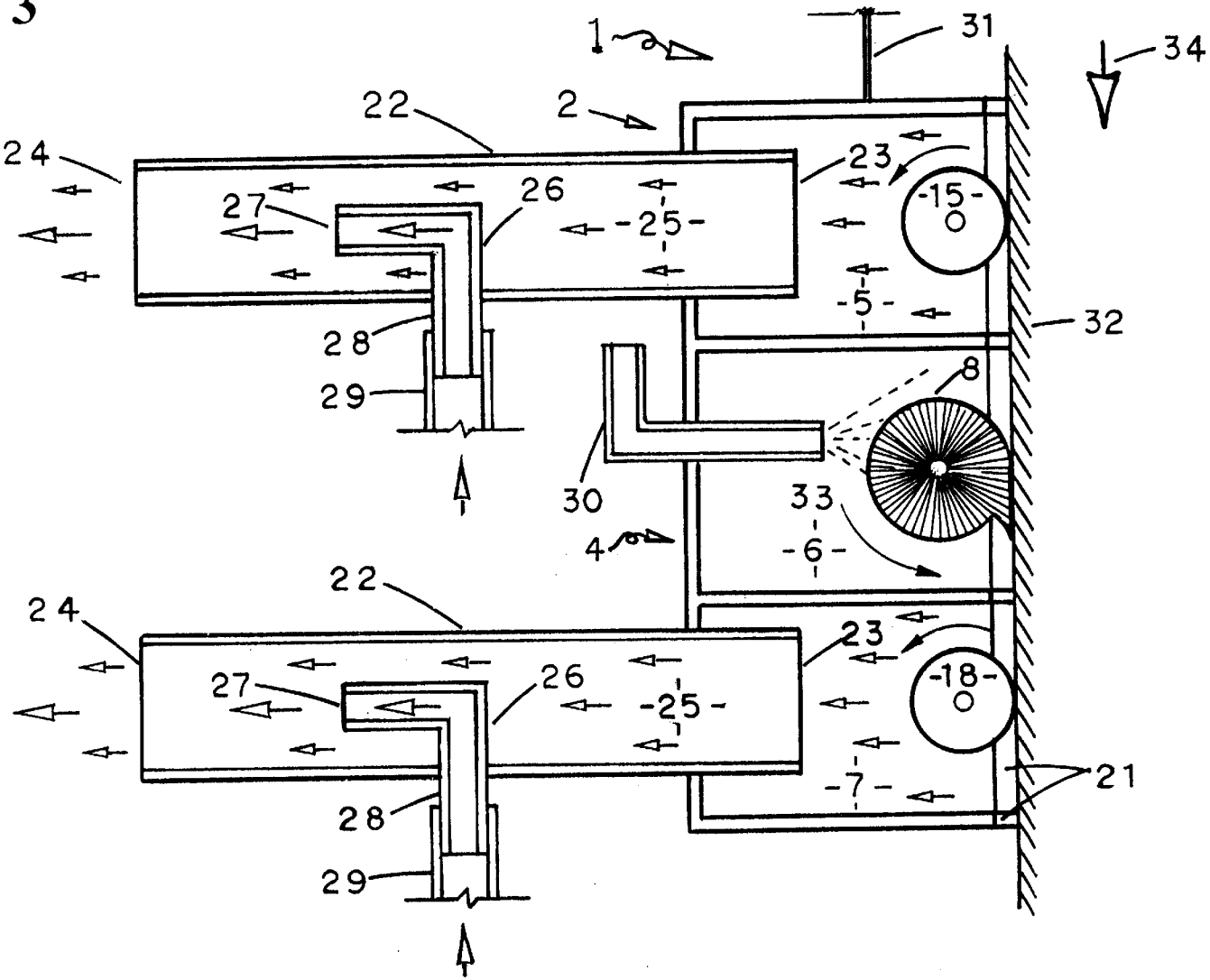
FIG. 3 shows how the invention operates.

As in FIG. 3, when a wall 32 of a high-rise building is to be cleaned, machine 1 is hanged at a top position of the area need to be cleaned by facing its anterior side 3 against wall 32 such that brush 8 contacts wall 32.

Upon operation, air pump is turned on, and air of high velocity and pressure is pumped through pipe 29 into tube 26. Air is propelled out from end 27 of tube 26 which is in space 25 of tube 22. This creates 2 forces exert upon machine 1 which is:

1. air propelled at high velocity and pressure out from end 27 causes a pneumatic action by drawing of air from inside chamber 5 and chamber 7 in a direction shown by horizontal arrows. Thus, a negative pressure is created inside chamber 5 and chamber 7 and forms a sucting force between rubber 21 and a surface to be cleaned.

2. air propelled at a high velocity and pressure out from end 27 is like a jet propellant thus also creates a pushing force to drive machine 1 to an opposite direction.

The two forces described in 1. and 2. when combined must be greater than the force brush 8 presses onto surface of wall 32 to be cleaned and must be great enough to press rollers 15 and 18 of the machine to contact against wall 32. The reason why the combination of the two forces must be greater than the force that brush 8 presses onto surface of wall 32 is that in normal situation the hair of brush 8 stretch out over edge of rubber plate 21 (as shown in FIG. 2). However, during operation of machine 1, the stretched-out hair is rotated and pressed onto surface 32. If the combined two forces is not greater than force that brush 8 presses onto surface of wall 32, then machine 1 will be pushed off from wall 32 and surface of rollers 15 and 18 will no longer contact the wall. This causes uneven moving of machine 1 and cleaning can not be efficiently performed.

When motor 13 is turned on, brush 8 is rotated in a direction shown by arrow 33 at the same time that tube 30 ejects water to brush 8. Simultaneously, machine 1 is lowered downward along the direction shown by arrow 34 and rollers 15 and 18 also move down.

During cleaning of wall 32 by machine 1, edge of rubber plate 21 touches on wall 32 and thus there will not be problem for machine 1 to move downward. While machine 1 is lowered downward, it is simultaneously pressed against wall 32, and brush 8 rotates and cleans the wall all the time until the cleaning cycle is completed. Air pump and water pump are then turned off.

Figure 4:
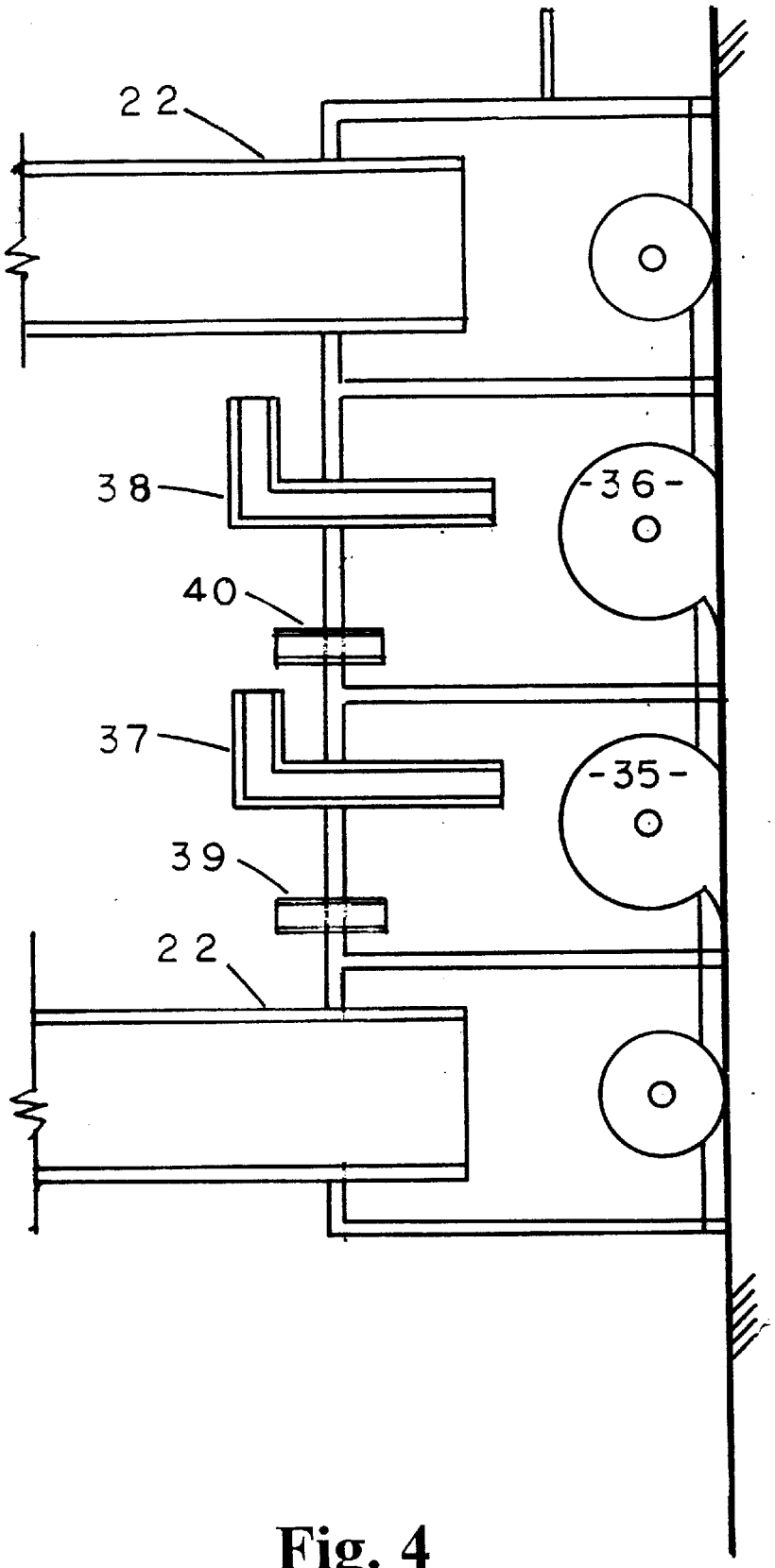
FIG. 4 shows the invention of pneumatic type with additional components.
Figure 5:
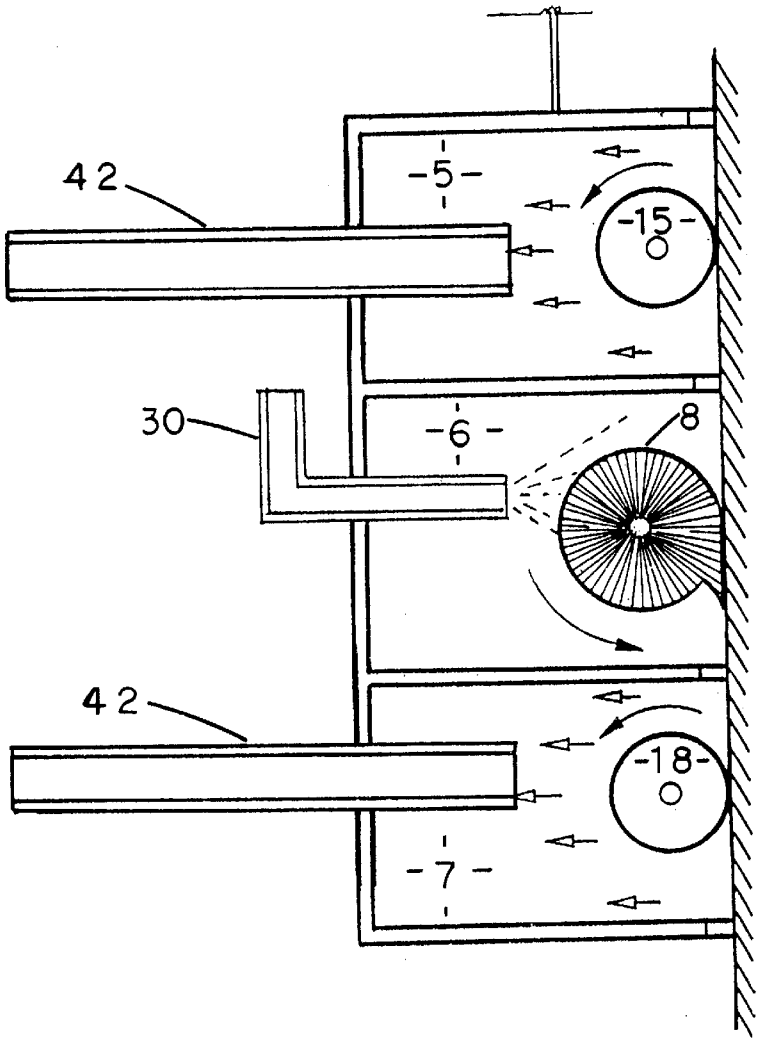
FIG. 5 shows how the invention of vacuum type operates.

FIG. 4 shows that, to increase the efficiency of cleaning, more than one set of drum-brush can be used. Brushes 35 and 36 are used. Tube 37 ejects detergent solution to drum-brush 35 and tube 38 ejects water to drum-brush 36 and makes cleaning much better. Excessive detergent solution or water is drained through outlets 39 and 40, respectively.

2. Vacuum System:

A vacuum system can be also used instead of a pneumatic system where a vacuum pump of high power must be used to suck air out of chamber 5 and chamber 7 through tube 42. Negative pressure is created inside the two chambers allows machine 1 to be pressed against wall 32.

Steps for cleaning, however, are the same as those in 1.

Figure 6:
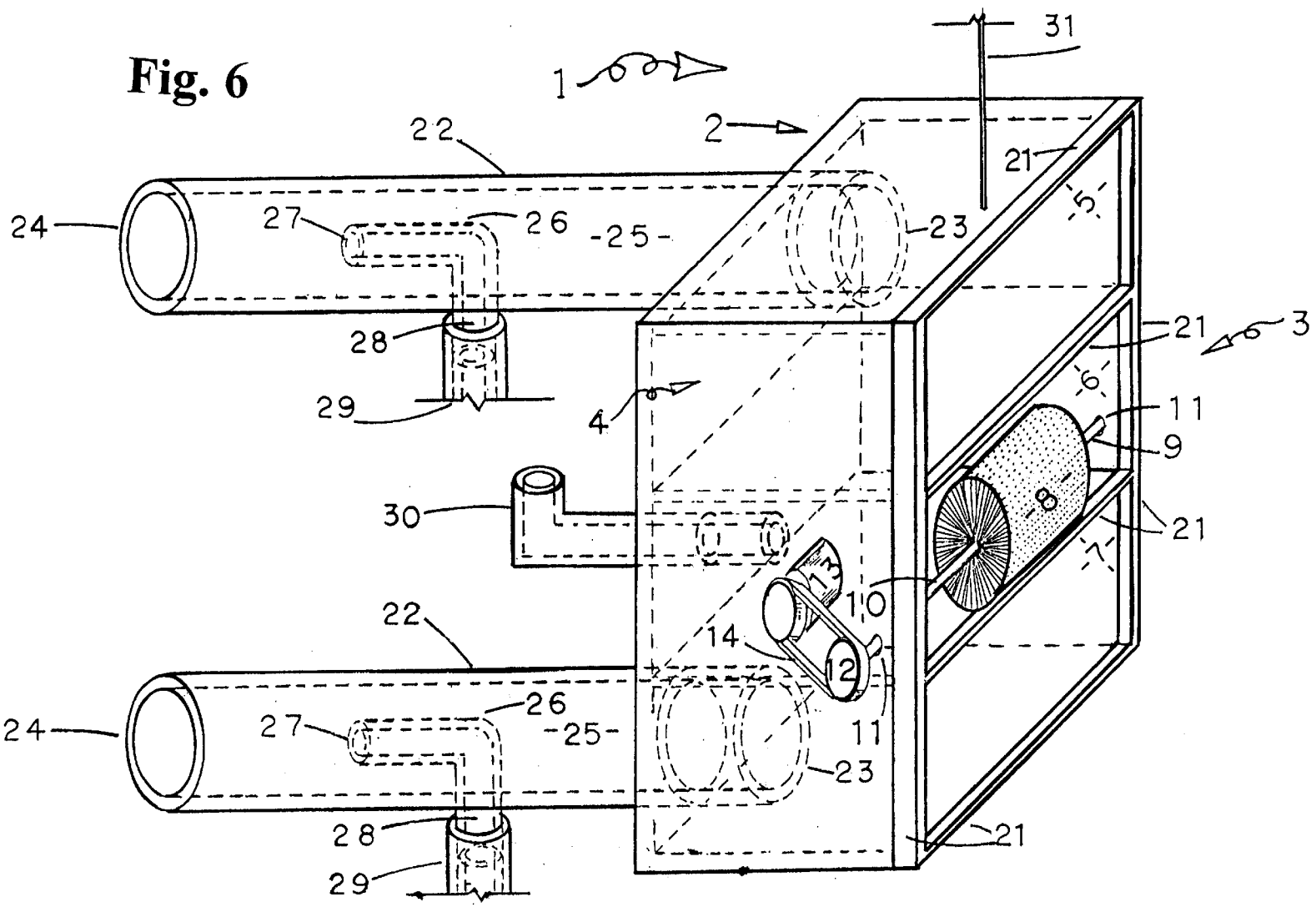
FIG. 6 shows the invention without rollers.

In different embodiments, as shown in FIG. 6, machine 1 may not have rollers 15 and 18 since rubber plate or brush 21 can perform the same function. This helps to make the machine lighter. But the disadvantage is that machine 1 will not be uniformly pressed onto the wall.

Figure 7:
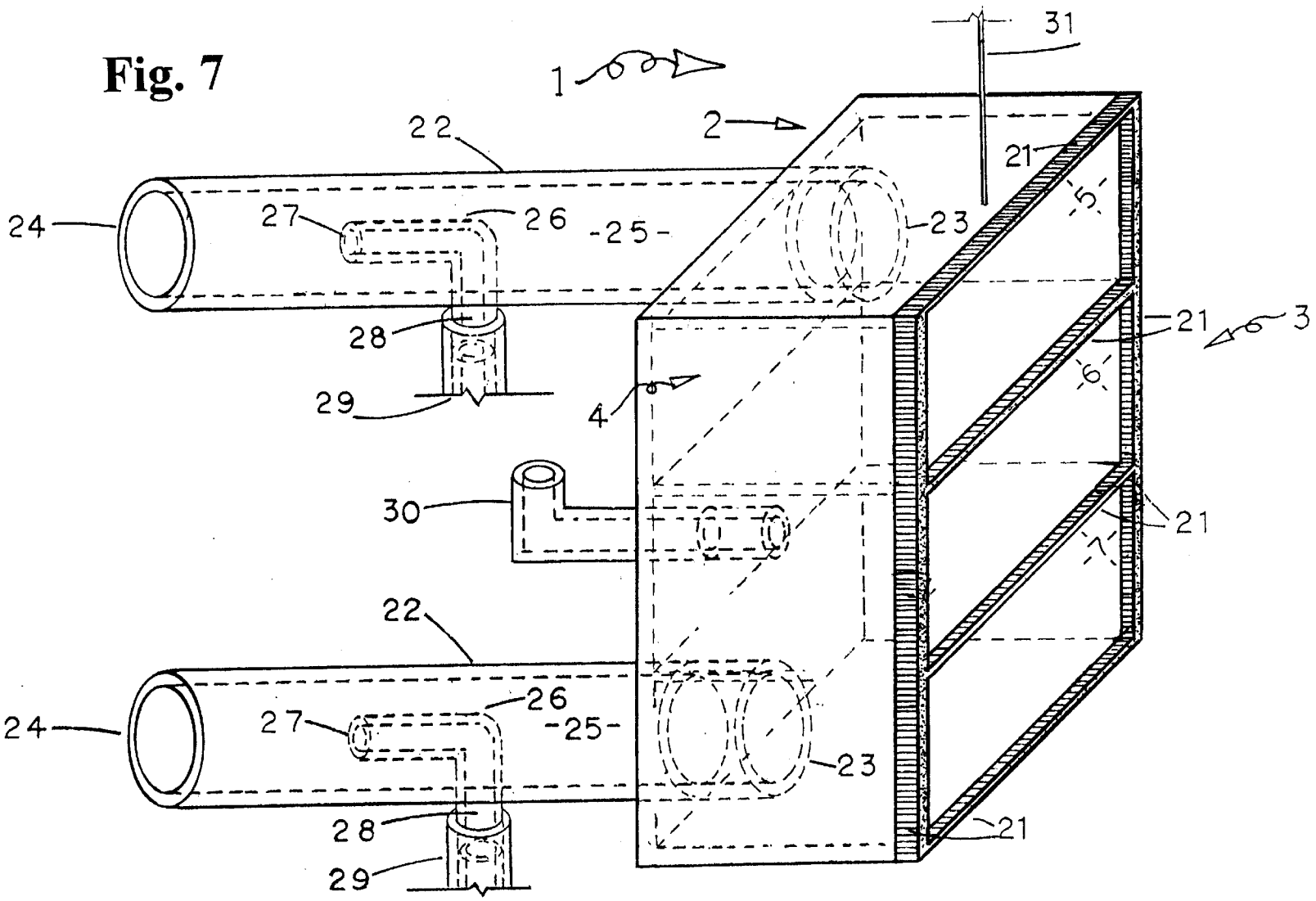
FIG. 7 shows the invention without rollers, brush and motor.

In addition, as shown in FIG. 7, machine 1 may not use rollers, brush 8 and motor 13. However, element 21 must be only brush edge and can not be rubber plate such that brush 21 when pressed and move along a wall will do the rubbing action and thus can replace brush 8.

To control the functions of machine 1, a conventional remote control system can be applied.

It will be understood that changes may be made within the scope of this invention by one of ordinary skill in the art without departing from the spirit thereof. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

What is claimed is:

1. A machine for cleaning outer wall of a high-rise building using pneumatic system to press said machine against a wall consists of:

a case divided into at least 3 chambers vertically arranged having an opened-anterior side where edges of all said chambers having one of rubber plates and brushes mounted all along their rims;

there mounted in an upper and a lower chamber a roller having its surface aligned with an edge of said rubber plates or brushes;

at the back of each of said upper and lower chambers, there is a hollow tube mounted thereto with one end inside and the other end outside each chamber;

within each hollow tube at the external part outside said case, there is a right-angled tube installed with its one end inside said hollow tube pointed away from said case and another end outside said hollow tube connected to an air pump in a manner that when said air pump is turned on, air is pumped outside said upper and lower chambers through the end of said right-angled tube inside said hollow tube to drive said machine in addition to create negative pressure within said upper and lower chambers resulting in pressing said machine against a wall to be cleaned;

machine can move while cleaning by shifting a cable tied at the top of said case;

in a middle chamber of said machine between the upper and lower chambers, there is a brush which can rotate to scrub a surface whose hair sticking out over the level of the edge of said rubber plates or brushes along the rims of the chambers, where at the back of said middle chamber there is tubing to eject water and/or detergent solution to said brush, and where said brush is motor-driven in cleaning said wall.

* * * * *